United States Patent [19]

Andersen

[11] 4,009,513

[45] Mar. 1, 1977

[54] PRODUCTION OF WARP OF TEXTURED YARNS OF UNIFORM PROPERTIES

[76] Inventor: Bjorn A. Andersen, Horseleg Creek Road, Rome, Ga. 30161

[22] Filed: Feb. 2, 1976

[21] Appl. No.: 654,669

[52] U.S. Cl. ..... 28/72.6

[51] Int. Cl.[2] ..... D02H 11/00; D02J 1/02

[58] Field of Search ..... 28/72 HR, 72.1, 72.14, 28/72.6, 75 WT, 1.4, 1.5, 1.6, 32, 35, 36; 264/342 R, 342 RF; 226/118, 120, 195

[56] References Cited

UNITED STATES PATENTS

| | | | |
|---|---|---|---|
| 2,453,332 | 11/1948 | Millhiser | 28/72.6 |
| 3,099,064 | 7/1963 | Haynes | 28/72 HR |
| 3,105,349 | 10/1963 | Palm et al. | 28/1.4 X |
| 3,298,079 | 1/1967 | Agett et al. | 28/72.14 |
| 3,558,393 | 1/1971 | Bolliand et al. | 28/72.1 X |
| 3,636,599 | 1/1972 | Stanley | 28/1.6 |
| 3,785,017 | 1/1974 | Jacob et al. | 28/72 HR |

*Primary Examiner*—Louis K. Rimrodt
*Attorney, Agent, or Firm*—Burgess, Dinklage & Sprung

[57] ABSTRACT

A plurality of synthetic fiber yarns which have latent bulk by virtue of false twist texturing or stuffer box crimping are pulled from a creel in the form of a warp between a first pair of rolls and then a second pair of slower moving rolls, passing through a steam chamber therebetween. This produces a pre-shrinking and evens out differences in tension and contractile force within the yarn ends, which renders them especially suitable for further processing as a warp, as in warp printing or dyeing. Since slack may periodically develop in individual ends between the first rolls and steam chamber, the first rolls are occasionally opened instantaneously, causing the slack to be taken out, and the rolls are then brought back together.

7 Claims, 3 Drawing Figures

PRODUCTION OF WARP OF TEXTURED YARNS OF UNIFORM PROPERTIES

Figure 1:
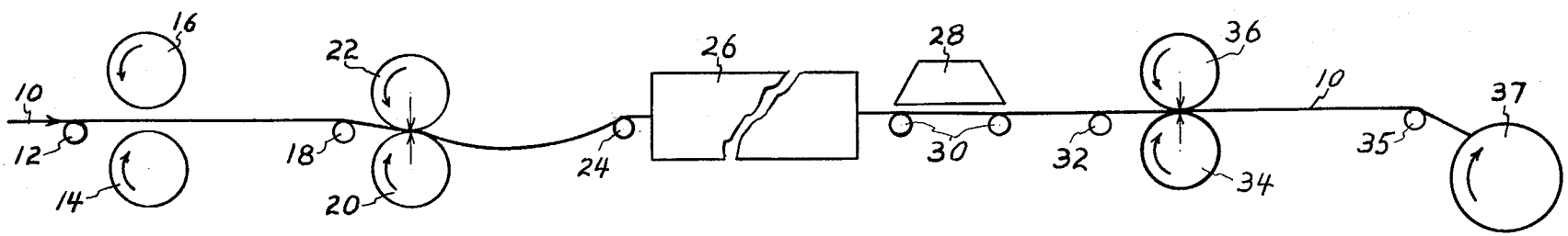

The present invention relates to a novel method or process, and equipment, for treating a plurality of yarns in the form of a warp so as to insure uniform tensions amongst the yarns in the warp during subsequent processing.

A number of textile processes require that a plurality of yarns be arranged so that a flat sheet of parallel yarns is formed, said sheet being known as a warp. A warp may contain only a few yarns or it may contain over a thousand ends of yarn, depending on the yarn size and the subsequent process. In some cases the warp comprising a plurality of yarns is wound on a beam prior to subsequent processing such as weaving or warp knitting. In some processes the plurality of yarns may be formed into a warp and passed continuously to subsequent processing steps as in warp dyeing or warp printing.

When conventional, non-textured, yarns are formed into a warp by use of adjustable pre-tensioning devices, reasonably uniform tensions have generally been achieved amongst the plurality of yarns. When textured or latent-texture yarns are processed in the form of a warp, however, severe tension control problems are frequently encountered, leading to highly variable tensions and often excessive tensions. Tension control is a particularly difficult problem in processes where the warp of latent-texture yarns is subjected to conditions which tend to develop the yarn texture or bulk, such as in warp dyeing or warp printing.

Textured yarns are yarns which have been mechanically or chemically treated to impart kinks, curls or crimps to the individual filaments comprising the yarn bundle. A large percentage of this crimp, kink or curl is pulled out of the yarn when it is wound on a cone or tube for shipment. This is not detrimental since the latent crimp, kink or curl will redevelop upon subsequent hot wet treatment such as dyeing of the yarn or fabric under relaxed conditions and the bulk or texture imparted to the yarn by the texturing process will be developed.

Many uses of textured yarn require that twist be inserted into the yarn. Often two or more ends of twisted yarn are ply-twisted together and heat-set to lock in or "set" the twist. This is normally followed by winding of the yarns onto cones for subsequent processing.

All of the above yarn processing steps can introduce variable tensions amongst the yarns. Other factors such as moisture content of the yarn during winding onto a cone, length of storage time on a cone, and the storage conditions of temperature and humidity all affect the yarn tensions on a package. As a result of all these factors, yarn tensions can vary within a yarn package as well as from package to package.

Textured or bulk yarns do not appear to have much bulk or texture when wound on a tube or cone. The latent bulk or texture develops rapidly when the yarn is subjected to hot or hot-wet processing conditions such as dyeing, steaming or drying. The development of bulk in a textured yarn is accompanied by contraction or shrinkage of the yarn. The variable yarn tensions due to the factors cited above result in variable yarn shrinkage or contraction upon development of the texture or bulk imparted to the yarn by the texturing process. For example, yarns from different cones of a commercial 2600 denier two-ply bulked (latent texture) continuous filament nylon yarn from the same yarn lot were steamed for 2 minutes at atmospheric pressure and, when left to contract without tension, some yarns contracted by as much as 30–31% while others contracted only 15–18% even though the degrees of bulk were substantially the same.

The highly variable shrinkage of textured yarns leads to variable tensions and tension control problems in the processing of a plurality of yarns in the form of a warp when the yarns are exposed to hot wet conditions such as in warp dyeing or warp printing. In warp dyeing the warp of yarns is fed into the process by a pair of nip rolls. After the application of dye to the warp, the warp enters a steamer to "fix" the dyes in the fibers. The warp is withdrawn from the steamer at a lower rate than the feed rate to allow for contraction of the yarns as they develop their bulk or texture. Some slight but positive tension on the yarns is desired to maintain control of the individual yarn ends in the warp. The speeds of withdrawal of the warp from the steamer and from the dryer downstream of the steamer are regulated to achieve the best compromise amongst yarn tensions in the warp. The result is that some yarns are under proper tensions, some are under tensions lower than desired and other yarns may be under excessive tensions which can result in fabric defects.

Another source of tension variation among the yarns in a warp is the varying tensions imposed on the yarns in pulling said yarns from the yarn supply packages in a creel to the point at which the yarns are brought together to form the warp. Creels containing several hundred supply packages of bulk or textured yarn may be a hundred or more feet long. Yarns coming from the far end of the creel encounter more drag and frictional resistance than those from the front of the creel, creating tension variations amongst the yarns in the warp.

It is accordingly an object of the present invention to eliminate the tension variations amongst a plurality of latent-texture yarns being pulled from a supply creel and formed into a warp.

It is another object of the invention to reduce the level of yarn contraction and to eliminate the variable yarn contraction encountered when processing a plurality of textured yarns in the form of a warp when said warp of textured yarns is subjected to conditions which result in development of the yarn bulk and the accompanying yarn contraction.

These and other objects and advantages are realized in accordance with the present invention which relates to an improvement in the method of processing a plurality of latent-texture yarns in the form of a warp so as to insure uniform tensions amongst the yarns in the warp during subsequent processing. The improvement of the present invention comprises pulling a plurality of yarns over suitable guides, from a yarn supply creel with a first pair of nip rolls, said nip rolls feeding the warp of yarns to a heated treatment chamber in which a steam atmosphere is maintained. A second pair of nip rolls is employed to pull the warp of yarns through the treatment chamber at a constant rate and feed the warp of yarns to subsequent processing such as warp dyeing, warp printing or winding of the warp on beams for storage prior to further processing. The speed of the first nip rolls feeding the warp of yarns to the treatment chamber is adjusted to maintain the warp in a slack condition between said feed rolls and said treatment chamber. The slack in the warp between the first feed rolls and the treatment chamber reduces yarn tensions to essentially zero and eliminates the variability in yarn tensions introduced by the varying distances the yarn must travel from the supply packages in the yarn supply creel. By maintaining the said slack in the warp of yarns they are under minimal tensions in the treatment chamber and are free to contract or shrink as they develop bulk in the steam atmosphere. As the plurality of yarns enter the second nip rolls which are drawing the warp through the treatment chamber they are under low and uniform tensions and, since the yarns have been free to bulk and contract in the treatment chamber independently of one another, said yarns all have low and essentially equal residual tendency to contract or shrink upon later developing the maximum bulk imparted to the yarns by the texturing process.

After a period of operation in which the proper amount of slack has been maintained in the high shrinkage yarns in the warp, the low shrinkage yarns will tend to develop more and more slack. Periodically the variation in the amount of slack in the warp should be eliminated. This can be accomplished by momentarily raising the upper roll of the first pair of feed rolls feeding the warp of yarns to the treatment chamber. As soon as the slack has been eliminated the upper roll of the feed rolls is lowered and the proper amount of slack reestablished between the feed rolls and the treatment chamber. This procedure momentarily imposes increased and variable tensions on the yarns in the warp.

Advantageously an additional pair of feed rolls, i.e., a third pair of rolls, is placed in series with and immediately upstream of the primary feed rolls to permit adjusting the slack between the primary feed rolls and the treatment chamber without subjecting the yarns to uncontrolled and variable tensions. The upper roll of the third pair of rolls is normally in the raised position so the warp passes through the opening between the rolls. To eliminate the variability in said slack the nip of the third pair of rolls is closed immediately upon separating the first pair of feed rolls. A very low but uniform tension is imposed on the yarns in the warp just upstream of the primary feed rolls thus causing the slack in the warp of yarns to shift to a position between the primary and secondary feed rolls, i.e., the first and third pairs of rolls. The nip of the primary feed rolls is then closed and the proper amount of slack reestablished between the primary feed rolls and the treatment chamber. The nip of the secondary feed rolls is opened immediately upon closing the nip of the primary feed rolls.

The novel process is especially suited for treating warps of textured yarns for subsequent in-line processing such as warp dyeing or warp printing where tension control and non-uniform tensions among the plurality of yarns in the warp is a continuing problem which results in yarns which do not develop their full bulk in the final fabric or cause fabric defects.

The novel process eliminates tension variations among the plurality of yarns in a warp introduced by pulling the yarns from the supply creel and treats said warp of yarns under such conditions that said yarns are free to develop bulk and contract independently of one another so that the residual shrinkage in the yarns is significantly lower than in the original supply yarns and further that the residual shrinkage is uniform amongst the plurality of yarns in the warp.

The heated treatment chamber may be divided into two or more compartments so that different temperature zones may be maintained. Non-heat set yarns which have been bulked by the process of the invention may be continuously heat set by adding a high temperature zone or compartment to the process. The warp of yarns may be supported in the treatment chamber by any suitable means such as stationary rods or other guides, or one or more open mesh conveyor belts.

The treatment chamber may be constructed to permit two or more warps, one above the other, to be treated simultaneously. This will allow more ends of yarn to be processed and/or permit greater spacing between adjacent yarn ends allowing for better control of the yarns in the warp and for greater access of steam to the yarn.

The warp of yarns cools rapidly upon emerging from the treatment chamber due to the low specific heat and large surface area of most yarns. An optional cooling zone may be incorporated after the treatment chamber to insure adequate cooling of the yarns in the warp.

Certain organic compounds are known to be dyeing assist agents, dye carriers or penetrants which enhance the dyeability of a fiber, these organic compounds generally being organic acids or alcohols, or certain organic aromatic compounds, the exact identity depending on the fiber to be dyed. These materials may be introduced into the treatment chamber as vapors which will condense on the yarns in the warp. In this way the yarns will be pretreated or preconditioned to enhance the dyeability of said yarns.

Figure 2:
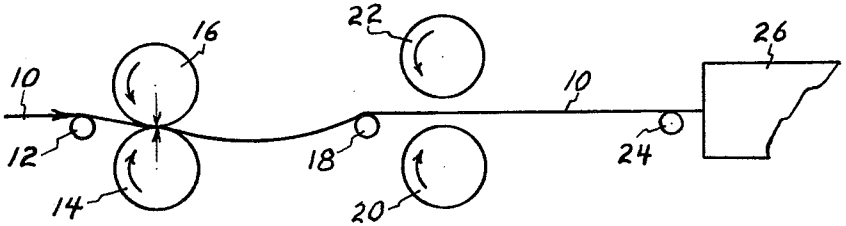
Figure 3:
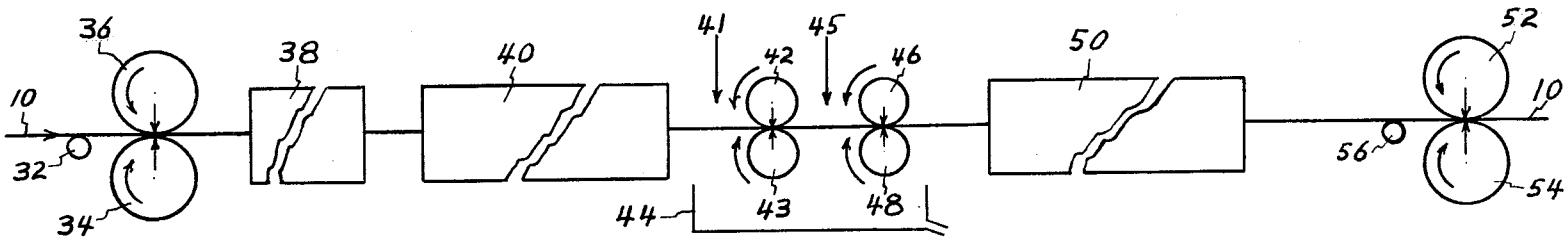

The invention will be further described with reference to the accompanying drawings wherein:

FIG. 1. is a schematic drawing of an apparatus for treating a plurality of yarns in the form of a warp so as to insure uniform tensions among the yarns during subsequent processing;

FIG. 2. is a schematic drawing of the apparatus when used intermittently to compensate for variable contraction or shrinkage among the plurality of yarns; and FIG. 3. is a schematic drawing of an apparatus for warp dyeing a warp of yarns processed in accordance with the invention.

Referring now more particularly to the drawings, in FIG. 1 there is shown a continuous warp 10 of a plurality of yarns pulled from a creel (not shown). The warp 10 is pulled through a nip defined between a first pair of rotating rolls 20 and 22. The roll 20 has a smooth metal surface. The roll 22 generally has a rubber surface to provide a more positive grip on all the yarns in the warp 10. The warp 10 is pulled over guide rods 12 and 18 which are so constructed that they guide and keep the plurality of yarns in the warp 10 parallel to one another. A second pair of rotating rolls 34 and 36 pulls the warp 10 over guide rod 24, through a treatment chamber 26, through an optional cooling zone defined by an air blower 28 and support bars 30 and thence over a guide rod 32.

In the heated treatment chamber 26 the textured yarns in the warp 10 are exposed to an atmosphere of steam or steam in admixture with certain organic vapors which causes the yarns rapidly to develop their bulk. Bulk development of the yarns is accompanied by contraction or shrinkage of the yarns in the warp 10. The feed rolls 20 and 22 are driven at a speed to maintain the yarns in the warp 10 in a slack condition between the nip defined between rotating rolls 20 and 22 and the guide rod 24. By maintaining the slack in the warp 10, the yarns in the warp 10 are under very low tensions and the yarns are free to contract and shrink as the yarn bulk is developed in the treatment chamber 26. Emerging from the treatment chamber 26, the warp 10 passes through the optional cooling zone defined by the air blower 28 and the support bars 30 and then over guide rod 32 to the nip defined between rolls 34 and 36. At the point where the plurality of yarns in the warp 10 enter the nip defined between rotating rolls 34 and 36 all the yarns are under low and essentially equal tensions and, further, all the yarns in the warp 10 have low and equal residual tendency to contract in the event of subsequent additional exposure to conditions which cause bulking of textured yarns.

After a period of operation as shown in FIG. 1 excessive slack will begin to develop among some of the yarns in the warp 10 between the nip of the feed rolls 20 and 22 and the guide rod 18. By momentarily opening the nip between feed rolls 20 and 22 additional tension is imposed on the yarns and all slack is eliminated. The nip between rolls 20 and 22 is quickly again closed and the speed of the feed rolls 20 and 22 is momentarily increased to obtain the desired amount of slack. This procedure momentarily imposes variable and higher tensions than desired on the yarns of warp 10.

A preferred procedure for effecting this involves a secondary pair of feed rolls or a third pair of rolls 14 and 16, their nip being normally open as shown in FIG. 1. When there is too much slack in some of the yarns as evidenced by a large catenary, the roll 22 is raised and roll 16 lowered as shown in FIG. 2. Variable slack among the yarns in warp 10 between the primary feed rolls 20 and 22 and the guide rod 24 is removed. The small controllable additional tension created by guide rod 18 causes the slack in the yarns of warp 10 to move to a location between guide rod 18 and the nip defined between rotating rolls 14 and 16. The nip between the primary feed rolls 20 and 22 is then again closed and the speed of the rolls 20 and 22 increased momentarily to produce the desired amount of slack in the warp 10 between the primary feed rolls 20 and 22 and the guide rod 24. As contact is made between rolls 20 and 22, the nip between rolls 14 and 16 is opened and the mode of operation reverts to that shown in FIG. 1.

The warp may then be passed over guide rod 35 and collected as a beam 37, or the yarns may be separated and collected as individual packages. Alternatively, the warp may be beamed, separated and collected or passed along for further processing such as dyeing as shown in FIG. 3. There, the warp 10 passes through a dyeing or printing apparatus 38 and one or more colors is applied. From the dyeing or printing operation the warp 10 passes continuously through a steamer 40 in which the yarns are exposed to a steam atmosphere to "fix" the dyes in the fibers. The steam atmosphere also causes the textured yarns to develop their latent bulk which is accompanied by contraction or shrinkage of the yarns. Leaving the steamer 40, the warp 10 is sprayed with water at 41 to wash off excess dye and dye chemicals. Rotating squeeze rolls 42 and 43 express excess water from the warp 10, the water draining into trough 44. The warp 10 is again sprayed with water at 45 prior to rolls 46 and 48 where the warp is again squeezed to express excess water. Two or more washings are generally used. To permit the yarns in the warp 10 to bulk and contract in the steamer 40, the speed of the squeeze rolls 42–43 and 46–48 is regulated to withdraw the warp 10 from the steamer 40 at a slower rate than it is being fed to the process by the rolls 34 and 36. To prevent entangling, the individual yarn ends must be under a slight tension, and this is easily achieved by the relative speeds of the rolls.

By contrast, if the warp 10 enters the nip between rolls 34 and 36 directly from a creel without the preshrinking and/or tension equalizing of FIGS. 1 and 2, the individual yarn ends of the product will not be uniform and processing problems will be encountered. Thus, to prevent entangling of the individual yarn ends the roll speeds will be selected to place some tension on the least contractile yarn. This means that other more contractile yarns will be under higher tensions and this will lead to yarn breaks and/or thin spots in the yarns which will in turn produce defects in fabrics made therefrom; it will also introduce non-uniformities during dyeing as the liquors cannot penetrate and act upon all the yarns evenly.

The novel process can be practiced even without the third pair of rolls 14,16, the periodic opening of rolls 20,22 causing the displacement of the slack from the position shown in FIG. 1 to that in FIG. 2 even without rolls 14,16. The duration of the opening of rolls 20,22 is of the order of one second so that, if the warp is advancing at about 100 feet per minute, less than 2 feet of yarn will be affected during the opening. The yarns during such roll separation will be momentarily subjected to a higher tension which will pull out the slack downstream of rolls 20,22. The presence of rolls 14,16 reduces even this minimum variation.

The separation of rolls 20,22 can be effected intermittently on a time basis, e.g., every 5 minutes for 1 second, or it can be effected in response to a tension or visual sensing apparatus which automatically separates the rolls when some ends have less than a certain amount of tension or when the catenary dips below a predetermined level, or the like. It can even be controlled manually by an operator.

The invention is applicable to yarns made up of any contractible fibers, particularly synthetic fibers such as nylon, polyester, acrylic, acetate and olefin. The yarns are preferably made up of continuous filaments although they may be staple fiber yarns with twist to hold them together. The denier of the individual fibers or filaments may vary widely, e.g., about 1 to 50 and generally about 3 to 15, and the denier of the individual yarn ends may also vary widely, e.g., about 150 to 3000 or more.

The latent bulk in the yarns may have been imparted by any of the known techniques, e.g., false twist texturing, stuffer box or gear crimping, fluid texturing, and the like, optionally followed by various amounts of heat setting and collection under sufficient tension so minimal bulk is visible in the yarn until later developed by heat without tension.

The invention will now be further described in the following illustrative examples with reference to the apparatus of the drawings.

EXAMPLE a. 400 Ends of suffer box crimped continuous filament nylon yarns, each comprising 2-ply of 2600 denier each, are passed from a creel through rolls 20,22 at 117 feet per minute and are pulled by rolls 34,36 at 90 feet per minute, the yarns having 5 seconds of exposure to steam at atmospheric pressure in the treatment chamber 26. The high shrinkage yarns thus contract 23.1% under the influence of the steam in the treatment chamber 26. Yarn tensions upstream of rolls 20,22 vary from 0.01 to 0.1 grams per denier. Yarn tensions between the treatment chamber 26 and rolls 34,36 vary from 0.001 to 0.002 grams per denier.

b. Once every minute rolls 14,16 close and, upon their contact, rolls 20,22 open for 1 second. The slack in the individual ends first moves upstream between guide 18 and rolls 14,16 and then disappears when, thereafter rolls 20,22 are again closed and, upon contact, rolls 14,16 are opened.

c. From rolls 34,36 the warp 10 of yarns passes through a pair of conventional dye applicator pad rolls (not shown) in the dyeing apparatus 38 at 90 feet per minute and at yarn tensions of from 0.001 to 0.002 grams per denier. The yarns are picked up by a conveyor in the dyeing apparatus 38 and transported to and through the steamer 40 at 87 feet per minute. The wash rolls 42,43 and 46,48 pull the yarns from the steamer at 88 feet per minute imposing tensions on the yarns of 0.002 to 0.005 grams per denier. From the wash rolls a conveyor transports the yarns through the dryer 50 at 87 feet per minute. Rolls 52,54 pull the yarns from the dryer conveyor at 87 feet per minute under tensions of 0.003 to 0.006 grams per denier. Downstream of rolls 52,54 the warp 10 is split into individual yarns and said yarns are guided to individual yarn cone packages (not shown) at 100 feet per minute and under tensions varying from 0.05 to 0.1 grams per denier.

d. The yarn product tufts through backing into carpeting which is coated with latex and laminated to a secondary backing fabric (or foam). Heating at 270° F to cure the latex simultaneously re-develops the bulk of the yarn. The carpet is uniform in appearance and free of thin stripes and streaks.

By way of comparison, if (b) is omitted and rolls 20,22 are not opened periodically, some of the yarns will have so much slack that they will wrap about roll 20 and cause a process breakdown. Rolls 14,16 need not be present and intermittently closed, and roll wrapping as described still will not occur, but their inclusion produces a superior product. If the procedures and equipment of (a) and (b) are omitted and the yarns from the creel are directly formed into a warp and passed to dyeing, the differing residual shrinkages in the initial yarns will carry through the process into the end product. Thus, the yarns having higher initial shrinkages will be subjected to high or excessive tensions and will not be able to develop their full bulk in the carpet, thereby showing up as "lean" yarns, i.e., thin spots.

Thus in a comparison test different samples of starting yarns of (a) were subjected to tension-free steaming for 2 minutes and the contractions measured. One contracted 21.2% and another 30.6%. By contrast, steaming the yarns for 5 seconds reduced their residual contractions to 4.2 and 4.8%, respectively, i.e., the pre-steaming evens out the variations in yarn properties.

By the process of the invention, therefore, warps can be prepared wherein the residual shrinkages of the individual ends, which may average from about 22 to 28% with nylon carpet yarns, may be reduced to below 10% for all yarns and preferably below about 5%. Even more important, whereas the differences in residual shrinkages of yarns making up the warp may initially vary quite widely, by the present invention their properties are rendered uniform, i.e., the residual shrinkages of the pre-steamed yarns of the warp will be within about 5% of one another and preferably within about 2%.

It will be appreciated that the instant specification and examples are set forth by way of illustration and not limitation, and that various modifications and changes may be made without departing from the spirit and scope of the present invention.

What we claim is:

1. A process comprising passing a plurality of synthetic yarns having latent texture from a supply into and through the nip of a first pair of rolls in the form of a warp, said yarns having residual shrinkage, driving said first pair of rolls so as to advance said warp, pulling said warp from said first pair of rolls with a second pair of rolls at a speed less than that of said first pair, heating said warp while moving between said first and second pair of rolls at a temperature and for a time sufficient to effect shrinkage of said yarns, the speed of said second pair of rolls being such as to maintain all of the yarns of said warp under almost tension-free condition between said first pair of rolls and the point of heating, and periodically separating said first pair of rolls from one another, whereby slack accumulated in individual yarns between said first and second pairs of rolls will be taken out and said yarns will be restored to equal tensions and a warp of pre-shrunk equally tensioned but almost tension-free synthetic yarns will issue from said second pair of rolls.

2. A process according to claim 1, including passing said warp over and in contact with a first guide bar upstream of said first pair of rolls, any slack in said yarns downstream of said first pair of rolls moving upstream of said first guide bar when said first pair of rolls is separated.

3. A process according to claim 1, including passing said yarns between a third pair of rolls upstream of said first pair of rolls, said third pair of rolls being normally separated from one another but being brought together when said first pair of rolls is separated, whereby any slack between said first and second pairs of rolls is moved upstream to between said third and first pair of rolls when said first pair of rolls is separated.

4. A process according to claim 3, including passing said warp over and in contact with a first guide bar downstream of said third pair of rolls and just upstream of said first pair of rolls, any slack in said yarns downstream of said first pair of rolls moving upstream of said first guide bar when said first pair of rolls is separated.

5. A process according to claim 4, including the further steps of pulling said warp by a fourth pair of rolls, dyeing or printing said warp between said second and fourth pair of rolls, whereby said yarns are colored and substantially uniform in residual shrinkage, and separately collecting the individual ends of said warp.

6. A process according to claim 1, including the further steps of pulling said warp by a fourth pair of rolls, and dyeing or printing said warp between said second and fourth pair of rolls, whereby said yarns are colored and substantially uniform in residual shrinkage.

7. A process according to claim 6, including the step of separately collecting the individual ends of said warp.

* * * * *